United States Patent [19]

Makita

[11] Patent Number: 4,600,920

[45] Date of Patent: Jul. 15, 1986

[54] DISPLAY DEVICE FOR PRODUCING OVERLAPPED DISPLAY OF CHARACTER PATTERNS

[75] Inventor: Masaru Makita, Tokyo, Japan

[73] Assignee: Canon Kabushiki Kaisha, Tokyo, Japan

[21] Appl. No.: 498,312

[22] Filed: May 26, 1983

[30] Foreign Application Priority Data

Jun. 15, 1982 [JP] Japan ..... 57-103540

[51] Int. Cl.[4] ..... G09G 1/14

[52] U.S. Cl. ..... 340/735; 340/748; 340/790

[58] Field of Search ..... 340/735, 748, 749, 750, 340/800, 790

[56] References Cited

U.S. PATENT DOCUMENTS

| | | | |
|---|---|---|---|
| 3,665,450 | 5/1972 | Leban | 340/748 |
| 3,696,387 | 10/1972 | Nussbaum | 340/749 |
| 3,711,849 | 1/1973 | Hasenbalg | 340/735 |
| 3,781,850 | 12/1973 | Gicca et al. | 340/722 |
| 4,107,786 | 8/1978 | Masaki | 340/749 |
| 4,163,229 | 7/1979 | Bobin et al. | 340/735 |
| 4,359,286 | 11/1982 | Barnes et al. | 340/735 |
| 4,491,832 | 1/1985 | Tanaka | 340/749 |

*Primary Examiner*—Gerald L. Brigance

*Attorney, Agent, or Firm*—Fitzpatrick, Cella, Harper & Scinto

[57] ABSTRACT

A display device comprises a dot-pattern character display unit, a read-only memory storing dot patterns representing ordinary characters, and a random-access memory for receiving plural data from said read-only memory for achieving an overlapping display.

3 Claims, 4 Drawing Figures

DISPLAY DEVICE FOR PRODUCING OVERLAPPED DISPLAY OF CHARACTER PATTERNS

BACKGROUND OF THE INVENTION

1. Field of the Invention

The present invention relates to a display device for character dot patterns, and more particularly to such a device capable of producing overlapped display of dot patterns using a simple structure.

2. Description of the Prior Art

In conventional typewriters or the like it has been necessary, for printing a symbol such as "¥", to make overlapped prints on a same sheet with the symbols "Y" and "=".

Recently developed electronic typewriters with a character display unit have facilitated the typewriting operation, but the display of the symbol "¥" on such display can only be achieved by the use of a separate pattern generator for the symbol "¥" or by the supply of signals through an OR gate from pattern generators for the symbols "Y" and "=".

However either method mentioned above inevitably requires a large and expensive device as the number of such overlapping symbols increases.

SUMMARY OF THE INVENTION

The object of the present invention is to provide a display device not characterized by the above-mentioned drawback, and such object can be achieved according to the present invention by a device comprising a read only memory storing ordinary character dot patterns and a random-access memory capable of storing overlapped character dot patterns.

DESCRIPTION OF THE PREFERRED EMBODIMENTS

Now the present invention will be explained in detail in conjunction with an embodiment shown in the attached drawings.

Figure 1:
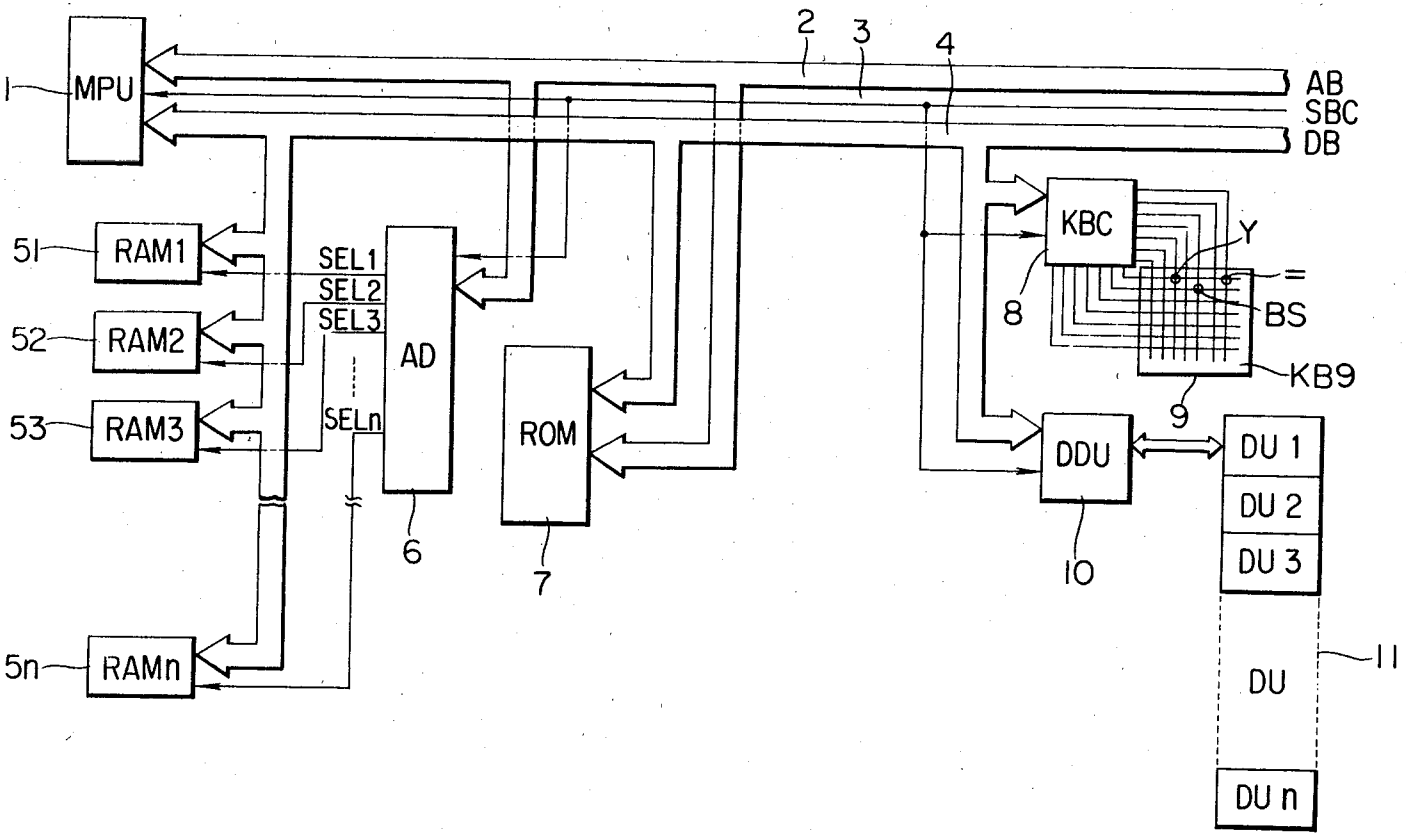
FIG. 1 is a schematic block diagram of the device of the present invention.
Figure 2A:
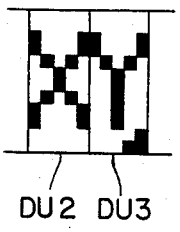
FIGS. 2A to 2C are views showing the function of a display unit capable of displaying overlapped characters.
Figure 2B:
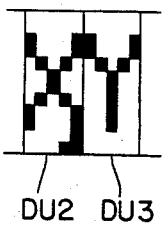
Figure 2C:
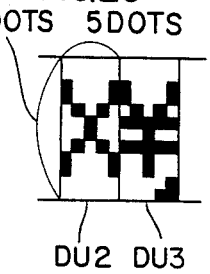

FIG. 1 is a schematic view of a display device embodying the present invention, wherein shown are a microprocessor (MPU) 1 for controlling the entire system; a keyboard (KB) 9 comprising plural keys as the character input means for the display device, wherein all key input signals from said keyboard 9 are received by the MPU 1 through a keyboard controller (KBC) 8 and a data bus (DB) 4; random access memories 51–5*n* for storing dot patterns to be displayed on an n-digit display unit (DU) 11, wherein the 1st, 2nd, . . . , n-th digits respectively corresponding to said random access memories 51, 52, . . . , 5*n*; address selectors SEL1–SELn supplying signals to said random memories and connected to an address decoder 6 for controlling the random access memories RAM1–RAMn with the MPU; a read-only memory (ROM) 7 for converting the input signals from the keyboard controller KBC into character codes, storing display dot patterns corresponding to various character codes and functioning as a character generator for generating display patterns in response to input character codes; and a display drive unit 10 for driving the display unit 11. The function of the above-described device will now be described with reference to FIGS. 2A to 2C. In the case of displaying a symbol "¥" on the third digit of the display unit DU by actuating a key "Y", a back space key BS and a key "=" in succession on the keyboard KB, upon actuation of the key "Y", the keyboard controller KBC reads matrix information from the keyboard KB and transmits said information to the data bus DB, and simultaneously supplies an interruption command to the microprocessor MPU. In response to the input of the key "Y" through said data bus, the MPU extracts an internal code representing the character "Y" from a corresponding address of the read-only memory 7, and supplies the internal code for "Y" and a command for cursor control to the display drive unit DDU, whereupon the display drive unit displays the character "Y" with the cursor at one digit position of the dot pattern display unit as shown in FIG. 2A. FIG. 2B shows the state of the display unit in which the cursor is displaced to a digit preceding the character to be overlapped, in response to the actuation of the back space key BS. Then, in response to the actuation of the key "=", there will be displayed the symbol "¥" as shown in FIG. 2C. As explained in the foregoing, the patterns "Y" and "=" are independently stored in the read-only memory 7. In the display unit shown in FIGS. 2A to 2C, each character is composed of 60 bits. In this state the MPU 1 recognizes that an overlapped display is to be made on the third digit of the display unit, thus reads the code for the pattern "Y" from the read-only memory 7 and stores said code in the random access memory 3. Then the code for the pattern "=" is similarly read from the read-only memory and stored in the random-access memory 3.

In the embodiment shown with reference to FIGS. 2A to 2C, each of the random-access memories RAM-1–RAMn is composed of 60 bits. The overlapped storage of the patterns "Y" and "=" in the random access memory RAM3 is equivalent to the temporary formation of a character generator for "¥", thus providing the display as shown in FIG. 2C.

The present invention is advantageous in requiring only a small and inexpensive device, since each overlapped character pattern is formed in a random access memory.

What I claim is:

1. A display device comprising:

(a) keyboard means for producing character code signals representing characters;

(b) character generating means for converting each character code signal produced by said keyboard means into a corresponding character pattern signal representing a character pattern;

(c) memory means for storing at locations therein character pattern signals supplied from said character generating means;

(d) means for visually representing a character pattern represented by the character pattern signal stored in said memory means;

(e) means for generating a composite character display signal; and (f) control means, responsive to a composite character display signal generated by said composite character display signal generating means, for causing a character pattern signal supplied from said character generating means after generation of a composite character display signal to be stored at a single location in said memory means in overlapping relation with a character pattern signal supplied from said character generating means before generation of the composite character display signal thereby to produce a composite character pattern signal.

2. A display device according to claim 1, wherein said character generating means includes a read only memory.

3. A display device according to claim 1, wherein said memory means includes a random access memory.

* * * * *